US008789477B2

(12) United States Patent
Jimenez Mangas et al.

(10) Patent No.: US 8,789,477 B2
(45) Date of Patent: Jul. 29, 2014

(54) TABLE FRAME

(75) Inventors: Miguel Jimenez Mangas, Guipuzcoa (ES); Carlos Tiscar Ribeiro, Guipuzcoa (ES)

(73) Assignee: Sellex, S.A., Irun (ES)

( * ) Notice: Subject to any disclaimer, the term of this patent is extended or adjusted under 35 U.S.C. 154(b) by 244 days.

(21) Appl. No.: 13/139,286

(22) PCT Filed: Dec. 11, 2009

(86) PCT No.: PCT/ES2009/000567

§ 371 (c)(1),
(2), (4) Date: Sep. 22, 2011

(87) PCT Pub. No.: WO2010/066922

PCT Pub. Date: Jun. 17, 2010

(65) Prior Publication Data

US 2012/0000402 A1 Jan. 5, 2012

(30) Foreign Application Priority Data

Dec. 12, 2008 (ES) ..... 200803532

(51) Int. Cl.
*A47B 3/00* (2006.01)

(52) U.S. Cl.
USPC ..... 108/115; 108/159.12; 108/122

(58) Field of Classification Search
USPC ..... 108/115, 118, 154, 155, 157.1, 159.12, 108/121, 122, 124, 128, 157.17; 403/91, 403/92, 95, 96; 248/150, 166, 188.6
See application file for complete search history.

(56) References Cited

U.S. PATENT DOCUMENTS

| | | | | | |
|---|---|---|---|---|---|
| 66,813 | A | * | 7/1867 | Doty | 108/115 |
| 1,209,679 | A | * | 12/1916 | Decker | 5/116 |
| 1,652,942 | A | * | 12/1927 | James | 108/159 |
| 1,800,685 | A | * | 4/1931 | Griffis | 108/159.11 |
| 1,939,904 | A | * | 12/1933 | Koopman | 108/157.18 |
| 2,086,380 | A | * | 7/1937 | Flagstad | 108/124 |

(Continued)

FOREIGN PATENT DOCUMENTS

| | | | |
|---|---|---|---|
| CH | 569447 | A5 | 11/1975 |
| CH | 686112 | A5 | 1/1996 |

(Continued)

OTHER PUBLICATIONS

International Search Report, International Application No. PCT/ES2009/000567, dated Apr. 13, 2010.

*Primary Examiner* — Janet M Wilkens
(74) *Attorney, Agent, or Firm* — Byrne Poh LLP

(57) ABSTRACT

Table frame that can be adapted to table tops of different dimensions and shapes, of the type that comprise a structure formed by a plurality of cross members supported by a plurality of supporting legs on which the table top is mounted, which comprises a first cross member and a second cross member joined together at an intermediate point of intersection that comprises an joint, said joint allowing the rotation of the first cross member and of the second cross member with respect to the point of intersection in a horizontal plane of rotation parallel to the surface of the table top, it being possible for said frame to adopt a position that may be selected from: a closed position in which the first cross member and the second cross member are positioned in parallel; and an open position in which the first cross member and the second cross member are positioned in the shape of a cross.

7 Claims, 6 Drawing Sheets

(56) References Cited

U.S. PATENT DOCUMENTS

| | | | | |
|---|---|---|---|---|
| 2,190,623 | A * | 2/1940 | Benson | 248/150 |
| 2,791,477 | A * | 5/1957 | Wesbecher | 108/124 |
| 2,829,934 | A * | 4/1958 | Schulze | 108/157.1 |
| 4,062,299 | A * | 12/1977 | Smith | 108/42 |
| 4,315,467 | A * | 2/1982 | Vanderminden | 108/157.15 |
| 4,825,781 | A * | 5/1989 | Palmer | 108/115 |
| 4,905,612 | A * | 3/1990 | Apissomian | 108/157.15 |
| 5,205,223 | A * | 4/1993 | Ball et al. | 108/124 |
| 5,232,303 | A * | 8/1993 | Rubner | 403/330 |
| 5,549,055 | A * | 8/1996 | Kusch | 108/159.11 |
| 7,059,220 | B1 * | 6/2006 | Liou | 81/124.5 |
| 7,168,580 | B2 * | 1/2007 | Larimer et al. | 211/200 |
| 7,415,933 | B2 * | 8/2008 | Sagol | 108/115 |
| 7,634,968 | B2 * | 12/2009 | Cornelius | 108/115 |
| 7,833,181 | B2 * | 11/2010 | Cormier et al. | 602/16 |
| 7,878,128 | B2 * | 2/2011 | Watson et al. | 108/132 |
| 2005/0039642 | A1 * | 2/2005 | Cornelius | 108/115 |
| 2006/0021550 | A1 * | 2/2006 | Sagol | 108/115 |
| 2006/0249637 | A1 * | 11/2006 | Houldsworth | 248/166 |
| 2010/0147200 | A1 * | 6/2010 | Polidoros | 108/157.16 |

FOREIGN PATENT DOCUMENTS

| | | | |
|---|---|---|---|
| DE | 20200400773 | U1 | 9/2005 |
| ES | 164429 | U | 1/1971 |
| ES | 265898 | U | 4/1983 |
| NL | 1010357 | | 4/2000 |

* cited by examiner

TABLE FRAME

This application is a national stage application under 35 U.S.C. 371 of International Application No. PCT/ES2009/000567, filed Dec. 11, 2009, which claims priority from Spanish Patent Application No. P200803532, filed Dec. 12, 2008, which are hereby incorporated by reference herein in their entireties.

FIELD OF THE INVENTION

The present invention relates to a table frame of the type comprising a structure formed by a plurality of cross members and their supporting legs, on which a table top is mounted, said table frame being adaptable to table tops of different dimensions and shapes.

BACKGROUND OF THE INVENTION

The table frames described above present important features, especially in relation to their use, manufacture, assembly, maintenance and even transport.

Specifically, said table frames permit, with a determined number of components, adaptation to table tops of different sizes and shapes, whether these are polygonal, curved or mixed. This adaptability has a direct repercussion on the manufacture of the frames themselves, since the same frame can be used to cover a determined number of different table configurations, entailing, among other advantages, an important reduction in stock and a simplification of manufacturing processes.

Also, assembly, maintenance and transport activities also benefit from the adaptability of these frames. Especially where maintenance is concerned, the replacement of one table top for another, allows, in determined cases, the original frame to be maintained.

The state of the art is familiar with table frames presenting the capacity to adapt to different types of table tops. Most of them are based on the use of one or more telescopic cross members which make it possible to slightly modify the table frame dimensions. For example, the one described in patent application DE10061926A1.

DE10061926A1 shows a table frame presenting a central telescopic cross member situated beneath the table top. Said cross member presents, at each one of its ends, two supporting legs fastened by a bracket which allows the separate rotation of each one of the legs. Also, each one of the supporting legs presents a horizontal cross member on which the table top is supported and fixing means at their ends to maintain it fixed to the frame. Depending on the variation in the longitudinal distance of the telescopic cross member and on the greater or lesser rotation of each one of the supporting legs a limited number of different table tops may be mounted.

The table frame shown in the patent application above presents several drawbacks, especially in relation to its assembly. Specifically, the adjustment of said table frame, like that of all those using telescopic cross members, must be carried out in several steps. In the first place, the length of the telescopic cross member must be adjusted or, in its absence, that of the telescopic cross members, adapting it to the length of the table top. In the second place, each one of the supporting legs must be rotated separately in order to adjust to the width of the table top. This entails an increase in the time employed in assembling the table, as well as an increase in the likelihood of error in assembling the table.

Another drawback of the table frame shown in patent application DE10061926A1, and in general of those table frames that present telescopic cross members, is that they tend to be configured by a significant number of components.

SUMMARY OF THE INVENTION

The present invention solves in a fully satisfactory manner the problems set out above by means of a table frame which presents a reduced number of components and which adjusts to an unlimited number of table tops of different shapes and sizes in a simple and efficient way, based on the simple rotation of one of its cross members.

To this effect, the table frame of the present invention comprises a structure formed by a first cross member and a second cross member supported by a plurality of supporting legs. The cross members and supporting legs are preferably made of metal, although they may be made of any other material, such as plastic or wood, as well as combinations thereof. They may also present any size and configuration, presenting either circular or rectangular sections, hollow or solid among others. Using fixing means, a table top is mounted on said cross members configuring the required table.

The first cross member and the second cross member are joined together at an intermediate point of intersection that comprises a joint, said joint allowing the rotation of the first cross member and of the second cross member with respect to the point of intersection in a horizontal plane of rotation to the surface of the table top, it being possible for said frame to adopt various positions.

One closed position in which the first cross member and the second cross member are positioned in parallel forming between them an angle $\beta$ of 0°. This position is specially designed to facilitate handling and transport of the frame to its place of assembly, since the frame in the closed position occupies a very small room.

One open position in which the first cross member and the second cross member are positioned in the shape of a cross forming between them an angle $\beta$, where $0° < \beta < 90°$, which allows the frame to be adapted to a determined table top according to its dimensions and its shape. Increasing the angle $\beta$ adapts the frame to wider tables, whereas decreasing said angle adapts it to longer table tops. The extreme case is when $\beta$ is equal to 90°. In this case, the first cross member and the second cross member are perpendicular to each other, resulting in an especially ideal case for tables with circular or curved shapes in general.

Both the first cross member and the second cross member are each configured by at least two separate parts, each separate part comprising at least one supporting leg and one end coupled to the joint.

The joint comprises a bottom part, a top part and a rotating shaft.

The bottom part comprises first coupling means of the separate parts of the first cross member and a bottom through-hole. Meanwhile, the top part comprises second coupling means of the separate parts of the second cross member and a top through-hole facing the bottom through-hole.

Preferably, to facilitate assembly of the frame's different components, the coupling means of the bottom part and the coupling means of the top part consist of a projection configured to be introduced by pressure into a cavity made in the ends of the separate parts of the first cross member and the separate parts of the second cross member. However, there are several alternative ways of joining the first cross member and the second cross member to the joint, for example by means of welding or by means of using various screws.

The rotating shaft passes through the bottom through-hole and the top through-hole to join both top and bottom parts, allowing the rotational movement of one with respect to the other and preventing horizontal and vertical shift between them. The rotating shaft comprises a cylindrical ferrule, a bolt, and a lock washer.

The cylindrical ferrule passes through the top through-hole and comprises a head at its top end and a plurality of notches at its bottom end distributed across its diameter.

The bolt passes through the bottom through-hole and screws into the cylindrical ferrule. The bolt comprises a rounded head at its bottom end configured for use with a tool that facilitates its screwing into the ferrule.

The lock washer is crossed by the bolt, and situated between the cylindrical ferrule and the rounded head. This lock washer comprises a plurality of projections which couple to the notches to join the movement of the bolt and the cylindrical ferrule.

The rotating shaft additionally comprises one or more washers selectable from flat washers and spring washers, or a combination thereof, positioned over the bolt situated between the rounded head and the lock washer.

The bottom part additionally comprises a bottom housing and at least one threaded hole. The bottom housing is configured to hide the bolt's rounded head, the lock washer, the flat washers and the spring washers.

The top part additionally comprises a top housing configured to hide the head of the cylindrical ferrule.

The lock washer additionally comprises at least one threaded drill hole facing the threaded hole of the bottom part which makes it possible to solidly join the rotating shaft to the bottom part using screws. In turn, the top part comprises on its surface a plurality of strategically distributed markers for each type of table top, while the head of the cylindrical ferrule comprises a pointer to face the markers of the top part. This enables, by positioning the markers of the top part facing the pointer of the cylindrical ferrule, pre-setting a determined number of positions wherein the first and second cross member present various angles β between them, corresponding to a determined number of table tops, enormously facilitating assembly tasks.

Finally, where the fixing means of the frame to the table top are concerned, various known fixing means can be used, for example using brackets or general screws among others. It is also possible, but unusual, to choose to directly support the table top on the cross members.

Preferably, the present invention uses fixing means which facilitate the table's assembly tasks to a great extent. Said fixing means comprise one or more lock levers, mounted on the ends of the first cross member and of the second cross member. The lock lever presents a rotational movement and comprises a bottom curved indent and a T-shaped protruding element. The rotational movement of the lock lever is limited by a stopper situated at each end of the first cross member and second cross member which interacts with the bottom curved indent.

Also, on the bottom surface of the table top one or more fastening parts are mounted in correspondence with the lock levers. Each one of the fastening parts comprises a receiving hole through which the protruding element of the lock lever is introduced. Each one of the fastening parts also comprises within at least one ramp configured for receiving one of the upper ends of the protruding element and to provide a tightening force on the fastening part through the rotational movement of the lock lever. Finally, the fastening parts comprise joining means for fixing to the table top through using screws.

The table top may also incorporate an auxiliary fastening part that is positioned facing the frame's joint and whose function is to provide greater support to the table top at its central point.

The mode of assembly of a table using the present invention is described hereafter. The table top and frame are supplied as separate elements. To facilitate transportation of the components to the place of assembly the frame is supplied in the closed position. In order to facilitate the table's assembly itself, the table top is supplied with the fastening parts fixed thereto, although obviously they can also be supplied separately for assembly by the user himself. Depending on the shape and dimensions of the table top, the user must turn either of the two cross members, until the pointer on the cylindrical ferrule coincides with the marker of the joint corresponding to the table top to be assembled. With both cross members forming the required angle .beta. between them, the table top is positioned to make the lock lever coincide with the fastening parts. Finally, the lock levers are turned to apply pressure on both parts, thereby fixing the table top to the frame.

The mode of replacing one table top with another is also really simple. In the first place, the original table top is released and separated from the frame. Subsequently, any of the cross members is rotated until achieving the new angle β corresponding to the new table top, with the help if necessary of the markers and pointer. Finally, the new table is positioned on the frame and the lock levers are turned.

BRIEF DESCRIPTION OF THE DRAWINGS

What follows is a very brief description of a series of drawings that help to better understand the invention and that expressly refer to an embodiment of said invention presented as a non-limiting example thereof.

PREFERRED EMBODIMENT OF THE INVENTION

The invention shall be described herein, by way of illustration only, using the following example which in no way shall be considered as limiting the scope of the invention.

Figure 1:
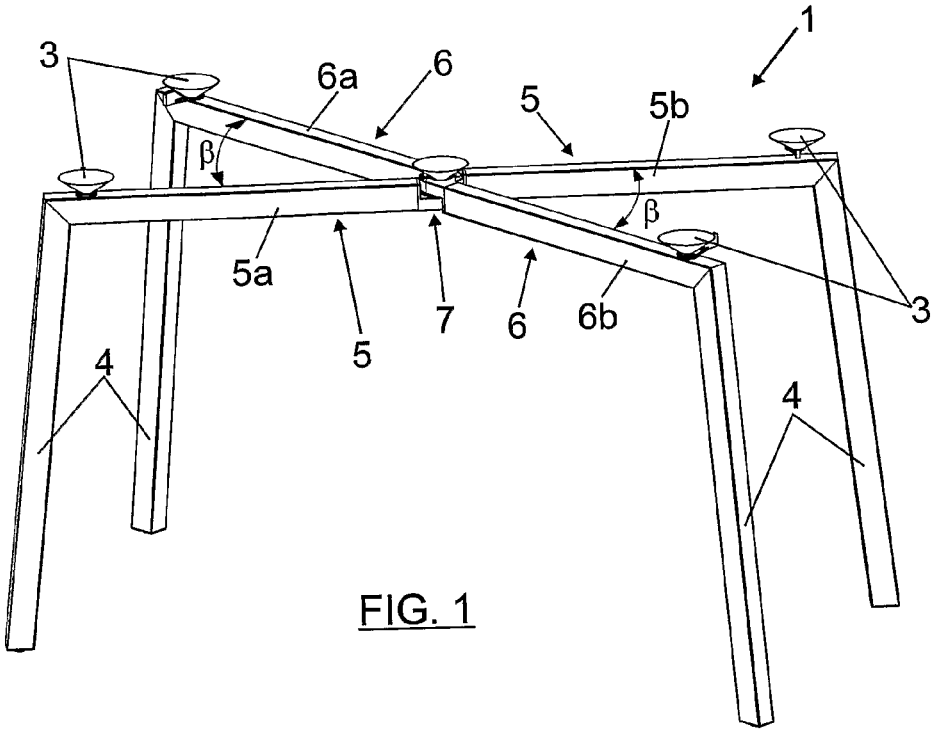
FIG. 1 is a perspective view of the frame in the open position.

FIG. 1 represents a perspective view of the frame (1) of the present invention. As may be appreciated, the frame (1) comprises a structure formed by a first cross member (5) and a second cross member (6), supported by a plurality of supporting legs (4). On said cross members (5, 6), using fixing means (3), a table top (2) is mounted, FIGS. 3 and 4, configuring the required table.

The first cross member (5) and the second cross member (6) are joined together at an intermediate point of intersection which comprises a joint (7), said joint (7) allowing the rotation of the first cross member (5) and the second cross member (6) with respect to the point of intersection on a horizontal plane of rotation parallel to the surface of the table top (2), it being possible for said frame (1) to adopt several positions.

Figure 2:
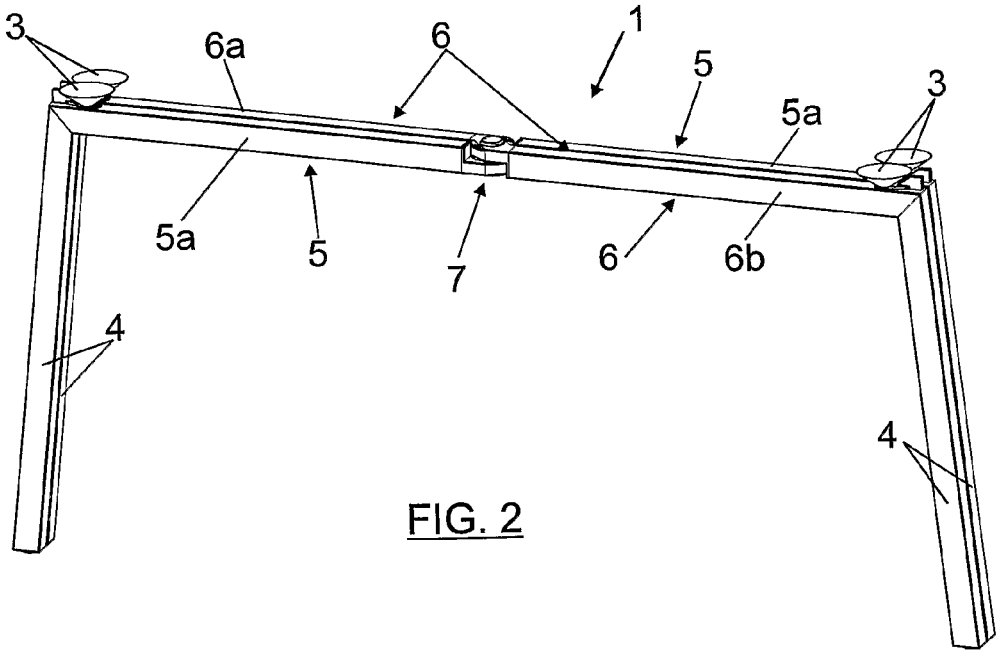
FIG. 2 is a perspective view of the frame in the closed position.

A closed position, in which the first cross member (5) and the second cross member (6) are positioned in parallel, forming between them an angle β of 0°. This position is represented in FIG. 2.

An open position in which the first cross member (5) and the second cross member (6) are positioned in the shape of a cross forming between them an angle β, where $0° < \beta < 90°$, which allows the frame (1) to be adapted to a determined table top (2) according to its dimensions and shape. The extreme case is found when β is equal to 90°, wherein the first cross member (5) and the second cross member (6) are perpendicular to each other.

Figure 3:
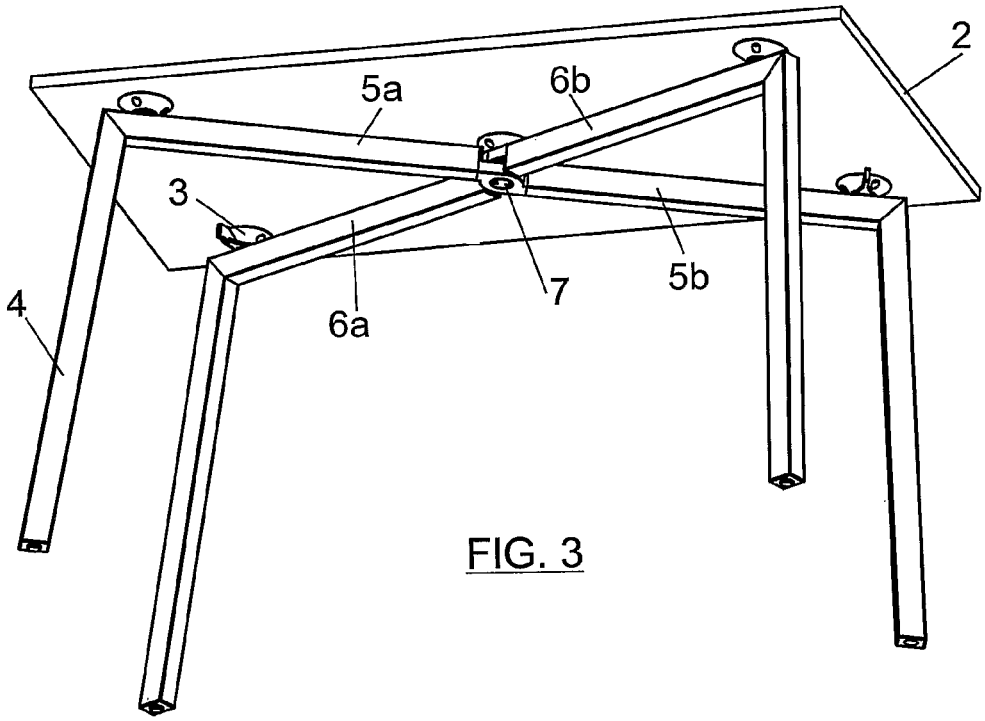
FIG. 3 is a perspective view of the frame on which a rectangular table top has been mounted.
Figure 4:
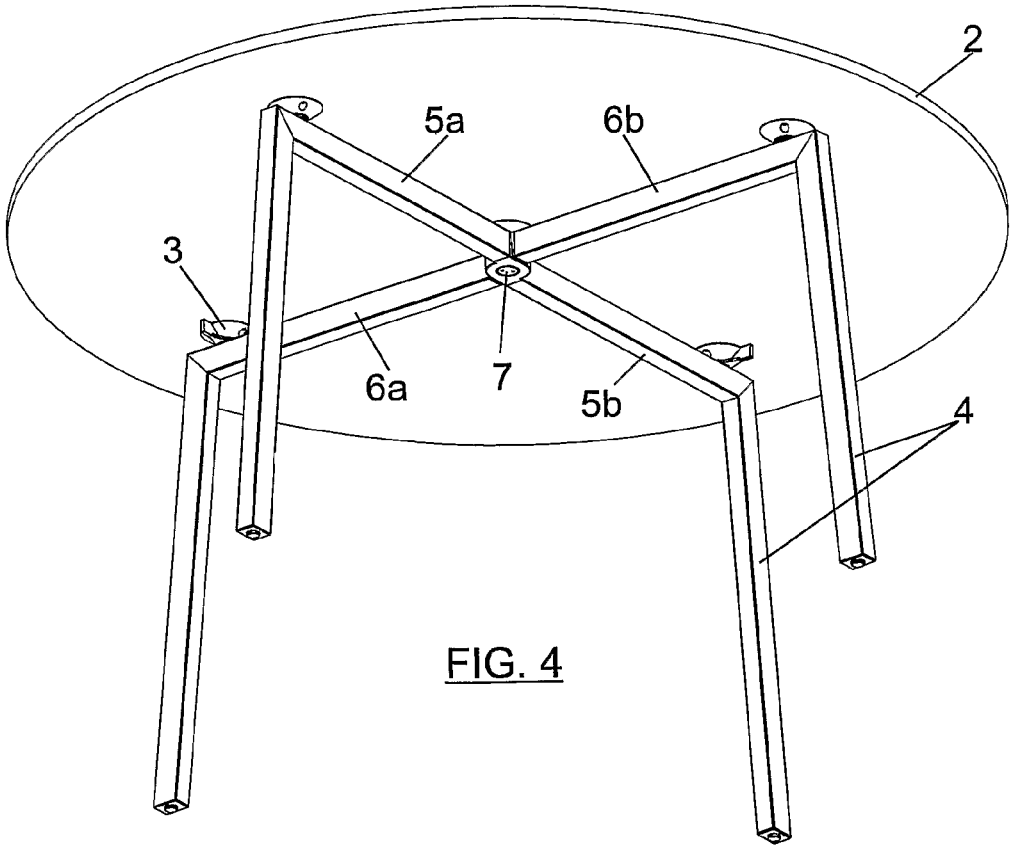
FIG. 4 is a perspective view of the frame on which a circular table top has been mounted.

FIGS. 3 and 4 show two examples of the frame (1) in the open position.

Specifically, FIG. 3 represents a perspective view of the frame (1) on which a rectangular table top (2) has been mounted. Meanwhile, FIG. 4 represents a perspective view of the frame (1) on which a circular table top (2) has been mounted.

Again in FIG. 1, it may be appreciated that both the first cross member (5) and the second cross member (6) are each configured by at least two separate parts (5*a*, 5*b*; 6*a*, 6*b*) respectively, each separate part (5*a*, 5*b*, 6*a*, 6*b*) comprising at least one supporting leg (4) and one end coupled to the joint (7).

Figure 5A:
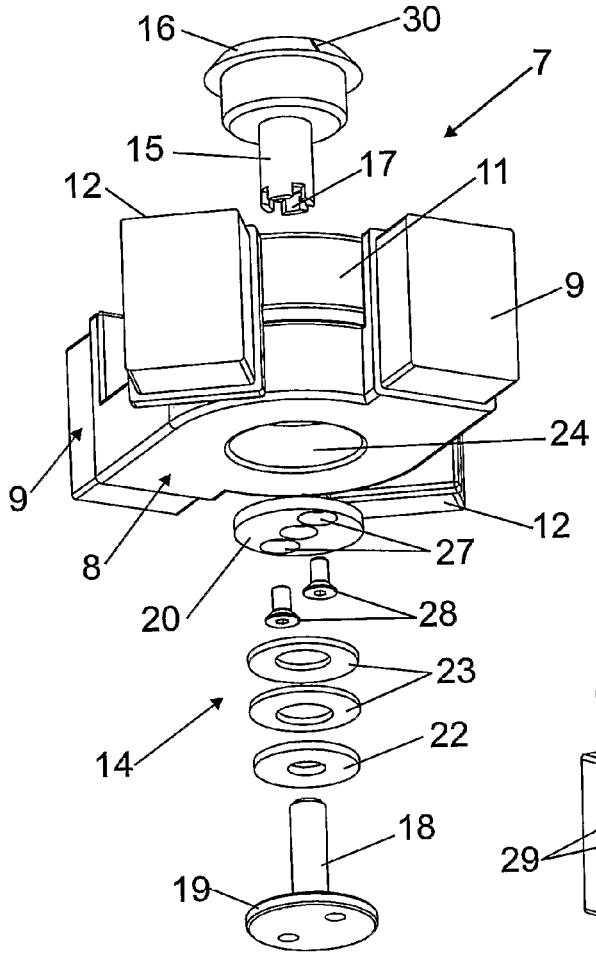
FIG. 5*a* is an exploded perspective view of the joint from a bottom viewpoint.
Figure 5B:
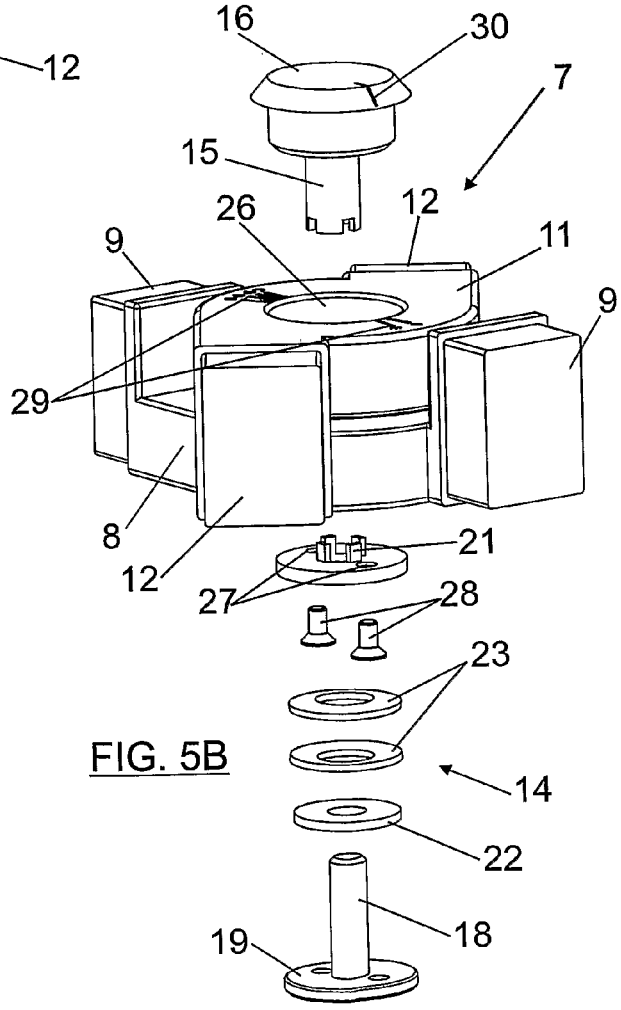
FIG. 5*b* is an exploded perspective view of the joint from a top viewpoint.
Figure 6A:
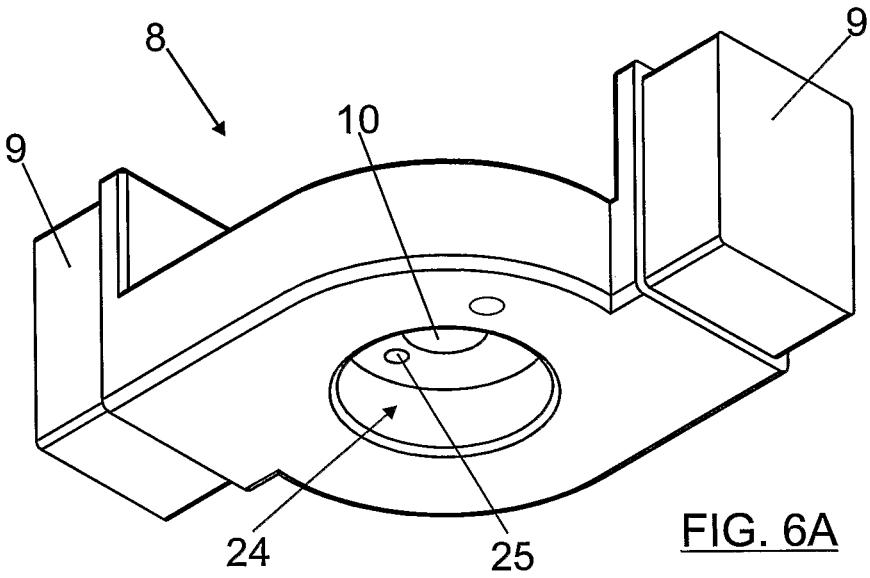
FIG. 6*a* is a perspective view of the bottom part.
Figure 6B:
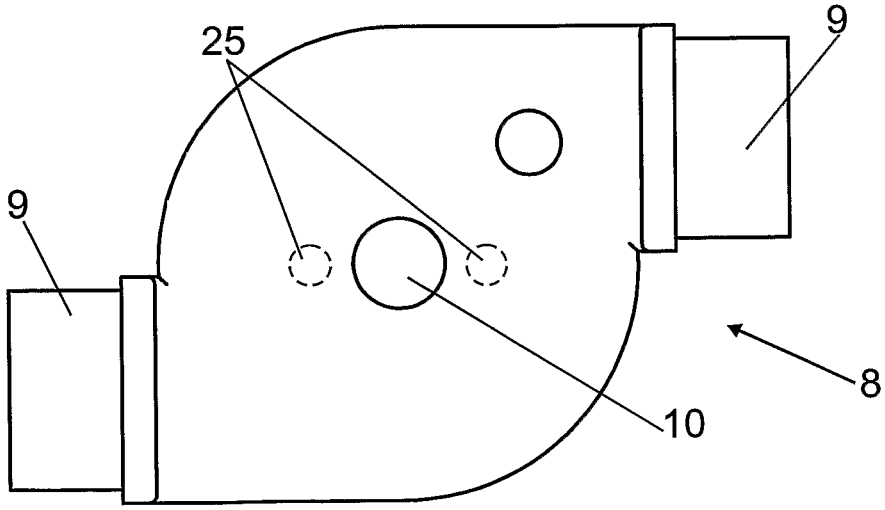
FIG. 6*b* is a plan view of the bottom part.
Figure 7A:
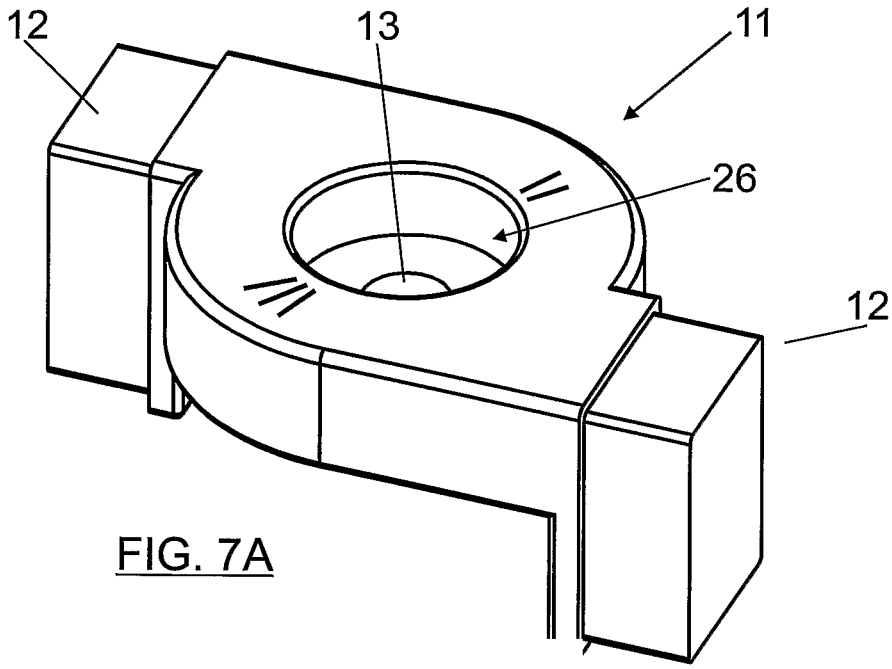
FIG. 7*a* is a perspective view of the top part.
Figure 7B:
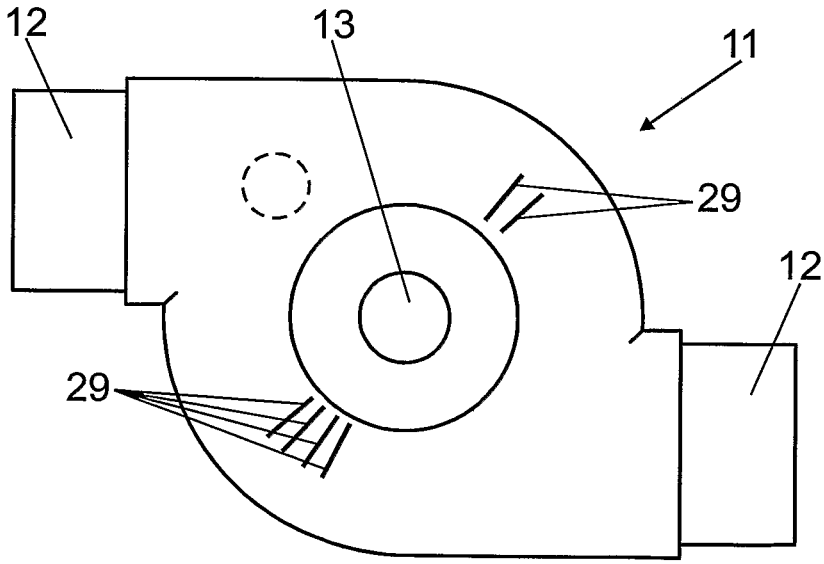
FIG. 7*b* is a plan view of the top part.
Figure 8A:
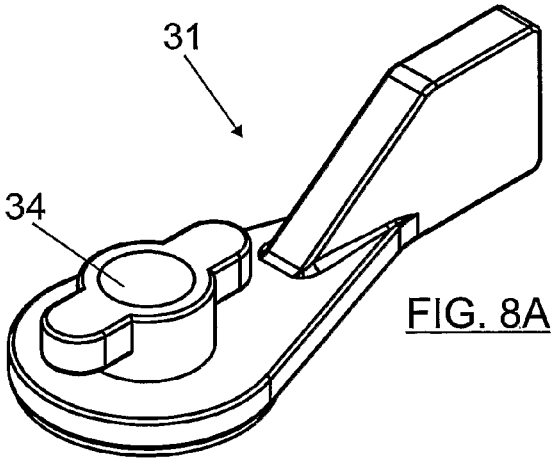
FIG. 8*a* is a perspective view of the lock lever.
Figure 8B:
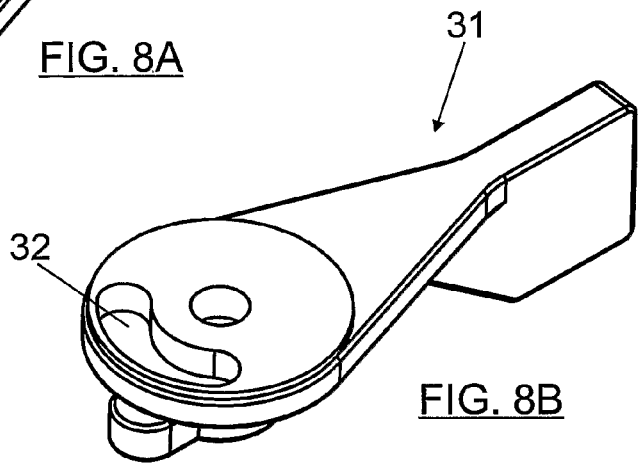
FIG. 8*b* is a perspective view of the reverse side of the lock lever.
Figure 9A:
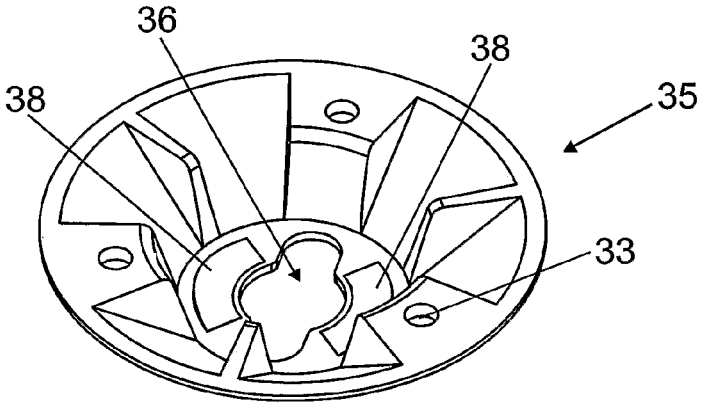
FIG. 9*a* is a perspective view of the fastening part.
Figure 9B:
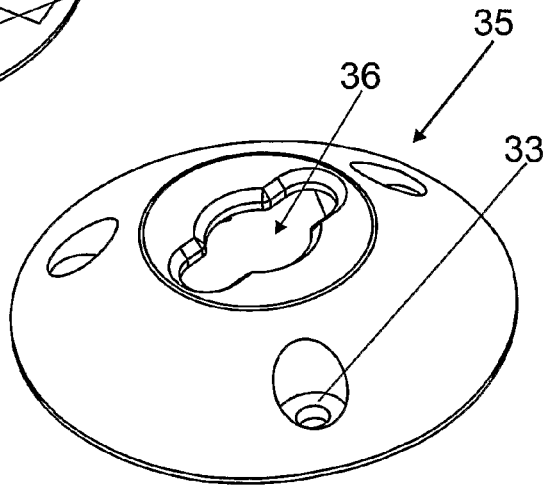
FIG. 9*b* is a perspective view of the reverse side of the fastening part.

FIGS. 5*a* and 5*b* show an exploded view of the joint (7) from a bottom viewpoint and from a top viewpoint respectively. In said FIGS. 5*a* and 5*b*, it can be appreciated that the joint (7) comprises a bottom part (8), a top part (11) and a rotating shaft (14).

FIGS. 6*a*, 6*b*, 7*a* and 7*b* show the bottom part (8) and the top part (11) in more detail.

The bottom part (8) comprises first coupling means (9) of the separate parts (5*a*, 5*b*) of the first cross member (5) and a bottom through-hole (10). Meanwhile, the top part (11) comprises second coupling means (12) of the separate parts (6*a*, 6*b*) of the second cross member (6) and a top through-hole (13) facing the bottom through-hole (10).

Preferably, to facilitate assembly of the frame's different components, the coupling means (9) of the bottom part (8) and the coupling means (12) of the top part (11) consist of a projection configured to be introduced by pressure into a cavity made in the ends of the separate parts (5*a*, 5*b*) of the first cross member (5) and the separate parts (6*a*, 6*b*) of the second cross member (6).

The rotating shaft (14) passes through the bottom through-hole (10) and the top through-hole (13) to join the bottom part (8) and top part (11), allowing the rotational movement of one with respect to the other and preventing horizontal and vertical shift between them. The rotating shaft (14) comprises a cylindrical ferrule (15), a bolt (18), and a lock washer (20).

The cylindrical ferrule (15) passes through the top through-hole (13) and comprises a head (16) at its top end and a plurality of notches (17) at its bottom end distributed across its diameter.

The bolt (18) passes through the bottom through-hole (10) and screws into the cylindrical ferrule (15). The bolt (18) comprises a rounded head (19) at its bottom end configured to be used by a tool that facilitates its screwing into the ferrule (15).

The lock washer (20) is crossed by the bolt (18), and situated between the cylindrical ferrule (15) and the rounded head (19). Said lock washer (20) comprises a plurality of projections (21) which couple to the notches (17) to join the movement of the bolt (18) and the cylindrical ferrule (15).

The rotating shaft (14) additionally comprises a flat washer (22) and two spring washers (23), crossed by the bolt (18), and situated between the rounded head (19) and the lock washer (20).

The bottom part (8) additionally comprises a bottom housing (24) and two threaded holes (25). The bottom housing (24) is configured to hide the rounded head (19) of the bolt (18), the lock washer (20), the flat washer (22) and the spring washers (23).

The top part (11) additionally comprises a top housing (26) configured to hide the head (16) of the cylindrical ferrule (15).

The lock washer (20) additionally comprises two threaded drill holes (27) facing the threaded holes (25) of the bottom part (8) making it possible to solidly join the rotating shaft (14) to the bottom part (8) using nuts screws (28). In turn, the top part (11) comprises on its surface a plurality of strategically distributed markers (29) for each type of table top (2), while the head (16) of the cylindrical ferrule (15) comprises a pointer (30) which is positioned facing the markers (29) of the top part (11). This enables, by facing the markers (29) of the top part (11) with the pointer (30) of the head (16) of the cylindrical ferrule (15), pre-setting a determined number of positions wherein the first cross member (5) and second cross member (6) present various angles β between them, corresponding to a determined number of table tops (2), enormously facilitating assembly tasks.

FIGS. 8*a*, 8*b*, 9*a* and 9*b* show two perspective views of the fixing means (3) of the frame (1) to the table top (2). Said fixing means (3) comprise a lock lever (31) mounted on the ends of the first cross member (5) and of the second cross member (6). The lock lever (31) presents a rotational movement and comprises a bottom curved indent (32) and a T-shaped protruding element (34). The rotational movement of the lock lever (31) is limited by a stopper situated at each end of the first cross member (5) and of the second cross member (6) which interacts with the bottom curved indent (32).

Also, on the bottom surface of the table top (2) one or more fastening parts (35) are mounted corresponding with the lock levers (31). Each one of the fastening parts (35) comprises a receiving hole (36) through which the protruding element (34) of the lock lever (31) is introduced. Each one of the fastening parts (35) also comprises inside at least one ramp (38) configured for receiving one of the upper ends of the protruding element (34) and to provide a tightening force on the fastening part (35) through the rotational movement of the lock lever (31). Finally, the fastening parts comprise joining means (33) for fixing to the table top (2) by means of using various screws.

The invention claimed is:

1. A table frame adaptable to table tops of different dimensions and shapes, said table frame comprising:

a structure comprising:

at least one first cross member;

at least one second cross member; and a plurality of supporting legs for supporting the at least one first cross member and the at least one second cross member, wherein:

the at least one first cross member and the at least one second cross member being configured and located so as to allow a table top to be mounted on the at least one first cross member and the at least one second cross member;

the at least one first cross member and the at least one second cross member being joined together at a point of intersection belonging to the at least one first cross member and the at least one second cross member;

the point of intersection defining a joint configured so as to allow the rotation of the at least one first cross member and the at least one second cross member with respect to the point of intersection in horizontal plane of rotation parallel to the surface of the table top, allowing the frame to adopt a position selected from one of:

a closed position, in which the at least one first cross member and the at least one second cross member are positioned in parallel, forming between them an angle β of 0°; and an open position in which the at least one first cross member and the at least one second cross member are positioned in the shape of a cross forming between them an angle β, where $0° < \beta < 90°$, allowing the frame to be adapted to a determined table top according to its dimensions and shape, the at least one first cross member and the at least one second cross member comprising each one at least two elongated parts, each elongated part comprising a first end attached to the joint and a second end attached to a respective one of the plurality of supporting legs, the joint being located between both elongated parts of each cross member;

the joint comprising:

a bottom part comprising:

first coupling means for separably coupling the elongated parts of the at least one first cross member; and a bottom through-hole;

a top part comprising:

second coupling means for separably coupling the elongated parts of the at least one second cross member; and a top through-hole facing the bottom through-hole; and a rotating shaft which passes through the bottom through-hole and the top through-hole to join both the bottom part and the top part, allowing the rotational movement of one with respect to the other and preventing horizontal and vertical shift between them.

2. The table frame of claim 1, wherein the rotating shaft comprises:

a cylindrical ferrule, which passes through the top through-hole and which comprises a head on its top end and a plurality of notches on its bottom end distributed across its diameter;

a bolt, which passes through the bottom through-hole and screws into the cylindrical ferrule, comprising a rounded head at its bottom end; and a lock washer crossed by the bolt, and situated between the cylindrical ferrule and the rounded head, said lock washer comprising a plurality of projections which couple to the notches to join the movement of the bolt and of the cylindrical ferrule.

3. The table frame of claim 2, wherein the rotating shaft additionally comprises one or more washers that are selected from one or more of flat washers and spring washers, crossed by the bolt situated between the rounded head and the lock washer.

4. The table frame of claim 3, wherein the bottom part additionally comprises:

a bottom housing configured to hide the rounded head of the bolt, the lock washer, the flat washers and the spring washers;

at least one threaded hole;

wherein the top part additionally comprises:

an upper housing configured to hide the head of the cylindrical ferrule.

5. The table frame of claim 4 wherein the lock washer additionally comprises at least one threaded drill hole facing the threaded hole of the bottom part making it possible to solidly join the rotating shaft to the bottom part using screws.

6. The table frame of claim 5 wherein the top part comprises on its surface a plurality of markers for different types of table tops, and in that the head of the cylindrical ferrule comprises a pointer which is positioned facing the markers of the top part to facilitate the assembly of a determined number of table tops.

7. The table frame of claim 1, further comprising:

a table top;

fixing means for mounting the table top on the frame, the fixing means comprising at least:

one lock lever, mounted on the first cross member and the second cross member, presenting the capacity to rotate and comprising:

a bottom curved indent which limits its rotational movement; and a T-shaped protruding element;

a fastening part mounted on the table top which comprises:

a receiving hole of the protruding element; and at least one ramp inside configured to receive one of the upper ends of the protruding element and to provide a tightening force on the fastening part through the rotational movement of the lock lever; and joining means to the table top.

* * * * *